US010773937B2

(12) United States Patent
Berns et al.

(10) Patent No.: US 10,773,937 B2
(45) Date of Patent: Sep. 15, 2020

(54) LIFT CHAIN TENSION RELIEVING DEVICES AND METHODS

(71) Applicant: Hyster-Yale Group, Inc., Fairview, OR (US)

(72) Inventors: Nico Berns, Alphen (NL); Paul Smulders, Nijmegen (NL); Peter van den Hurk, Meteren (NL); Joost Erinkveld, Arnhem (NL); Norbert Bruenell, Grevenbroich (NL); Stefan van der Cruijsen, Haps (NL)

(73) Assignee: HYSTER-YALE GROUP, INC., Fairview, OR (US)

( * ) Notice: Subject to any disclaimer, the term of this patent is extended or adjusted under 35 U.S.C. 154(b) by 0 days.

(21) Appl. No.: 16/410,841

(22) Filed: May 13, 2019

(65) Prior Publication Data

US 2019/0263647 A1 Aug. 29, 2019

Related U.S. Application Data

(62) Division of application No. 14/527,531, filed on Oct. 29, 2014, now Pat. No. 10,329,130.

(60) Provisional application No. 61/900,015, filed on Nov. 5, 2013.

(51) Int. Cl.
*B66F 9/075* (2006.01)
*B66F 9/08* (2006.01)

(52) U.S. Cl.
CPC ..... *B66F 9/07504* (2013.01); *B66F 9/08* (2013.01)

(58) Field of Classification Search
CPC ..... B66F 9/07504; B66F 9/08
See application file for complete search history.

(56) References Cited

U.S. PATENT DOCUMENTS 2,456,320 A * 12/1948 Repke ..... B66F 9/08 414/635
2,581,791 A * 1/1952 Gilman ..... B66F 9/205 187/226
3,786,902 A * 1/1974 Ramsey ..... B66F 9/08 187/227
3,851,732 A * 12/1974 Wagner ..... B66F 9/08 187/238
3,974,927 A * 8/1976 Schuster ..... B66F 9/148 414/667
4,030,568 A * 6/1977 Heinold ..... B66F 9/08 187/227
4,034,855 A * 7/1977 Stedman ..... B66B 7/046 187/226
4,544,323 A * 10/1985 Malin ..... B66F 9/12 187/226
4,896,748 A * 1/1990 Mikkelsen ..... B66F 9/08 187/226
4,921,075 A * 5/1990 Schumacher ..... B66F 9/06 187/229
6,264,004 B1 * 7/2001 Miyamoto ..... B66F 9/08 187/222
7,255,202 B2 * 8/2007 O'Keeffe ..... B66F 9/07563 187/234
2004/0251085 A1 * 12/2004 Kuwano ..... B66F 9/08 187/226

(Continued)

*Primary Examiner* — Michael A Riegelman
(74) *Attorney, Agent, or Firm* — Schwabe Williamson & Wyatt

(57) ABSTRACT

Devices and methods to relieve lift chains from being maintained under constant, or nearly constant, tension are provided.

7 Claims, 10 Drawing Sheets

(56) References Cited

U.S. PATENT DOCUMENTS

2011/0091306 A1* 4/2011 Roux ..... B66F 9/08
414/667

* cited by examiner

| | |
|---|---|
| 700 | ACTIVATE PARK BRAKE |
| | **ACTIVATION SPREADER SUPPORT SYSTEM** |
| 705 | SYSTEM (KEY) SWITCH ON |
| 710 | DETECT ACTIVATION OF PARK BRAKE |
| 710 | INDICATE SYSTEM ON, BLUE LIGHT CONTINUOUS UNTIL SYSTEM OFF |
| 715 | SYSTEM ACTIVATES PARK BRAKE LOCK |
| | **POSITION SPREADER IN RANGE ABOVE SUPPORT** |
| 720 | MOVE SPREADER TO POSITION |
| 725 | DETECT SPREADER IN RANGE, PROXIMITY SWITCH |
| 730 | ACTIVATE LOWERING INTERRUPT |
| 730 | ENABLE SWITCH "BEAMS OUT" |
| | **EXTEND SPREADER SUPPORT BEAMS** |
| 735 | PRESS AND HOLD [SWITCH CYLINDER OUT], MOMENTARY SWITCH |
| 735 | MOVE BEAMS TO EXTENDED POSITION |
| 740 | BEAMS NOT "IN" (DETECTED BY TWO PROXIMITY SWITCHES) |
| 740 | ACTIVATE REDUCED LOWERING SPEED |
| 745 | BEAMS IN EXTENDED POSITION |
| 745 | DISABLE SWITCH "OUT" WHEN BEAMS EXTENDED |
| 745 | DEACTIVATE LOWERING INTERRUPT |
| | **LOWER SPREADER ON SUPPORT BEAMS** |
| 750 | LOWER SPREADER (REDUCED LOWERING SPEED ACTIVE) |
| 755 | DETECT SPREADER ON SUPPORT BEAM, PROXIMITY SWITCH LEFT BEAM |
| 755 | ACTIVATE LOWERING INTERRUPT |
| 755 | ACTIVATE GREEN LIGHT |
| 755 | DISABLE SWITCH "BEAMS IN" |
| | **LIFT SPREADER ABOVE SUPPORT BEAMS** |
| 760 | *LIFT SPREADER* |
| 765 | DETECT SPREADER NOT ON SUPPORT BEAM, (PROXIMITY SWITCH LEFT BEAM) |
| 765 | ENABLE SWITCH "BEAMS IN" |
| 765 | DEACTIVATE LOWERING INTERRUPT |
| 765 | DEACTIVATE GREEN LIGHT |
| | **RETRACT SPREADER SUPPORT BEAMS** |
| 770 | BEAMS MOVES TO RETRACTED POSITION |
| 775 | DETECT BEAMS NOT IN EXTENDED POSITION |
| 775 | ENABLE SWITCH "BEAMS OUT" |
| 775 | ACTIVATE LOWERING INTERRUPT |
| 780 | BEAMS IN RETRACTED POSITION |
| 780 | DEACTIVATE REDUCED LOWERING SPEED |
| 780 | DEACTIVATE LOWERING INTERRUPT |
| 780 | ENABLE SWITCH "BEAMS OUT" ONLY WHEN SPREADER IN RANGE |
| 780 | DISABLE INPUT SWITCH "BEAMS IN" |
| | **DEACTIVATION SPREADER SUPPORT SYSTEM** |
| 785 | SYSTEM (KEY) SWITCH OFF |
| 790 | INDICATE SYSTEM OFF, BLUE LIGHT CONTINUOUS OFF |
| 790 | ENABLE PARK BRAKE DEACTIVATION |

FIG. 7

LIFT CHAIN TENSION RELIEVING DEVICES AND METHODS

STATEMENT OF RELATED MATTERS

This application is a division of U.S. patent application Ser. No. 14/527,531, now U.S. Pat. No. 10,329,130, issued Jun. 25, 2019, which claims priority to U.S. Provisional Application No. 61/900,015, filed Nov. 5, 2013, the contents of which are all herein incorporated by reference in their entirety.

TECHNICAL FIELD

The field of the present disclosure relates to accessories for truck masts.

SUMMARY

The present inventors have recognized that lift chains on certain lift truck masts are typically under constant, or nearly constant, tension. For example, when the mast is not fully lowered with an attachment resting on the ground the lift chains are under constant tension. For some lift trucks in certain applications, such as empty container handling, the lift chains rarely, if ever, are relieved from being tensioned. Some lift truck lift chains therefore carry a relatively large proportion of the rated load for a lift truck, even when not lifting a load, because of the construction, kinematics, dimensions, and weight of attachments secured to the mast.

The present inventors have also recognized that maintaining lift chains under constant, or nearly constant, tension inhibits effective lubrication of such chains. The present inventors have also recognized that maintaining lift chains under constant, or nearly constant, tension typically reduces lift chain life.

To address the above, and other problems, the present inventors created devices and methods to relieve lift chains from being maintained under constant, or nearly constant, tension.

BRIEF DESCRIPTION OF THE DRAWINGS

FIG. 7 illustrates a flow chart of another exemplary method of relieving tension from lift chains.

DETAILED DESCRIPTION

Figure 1:
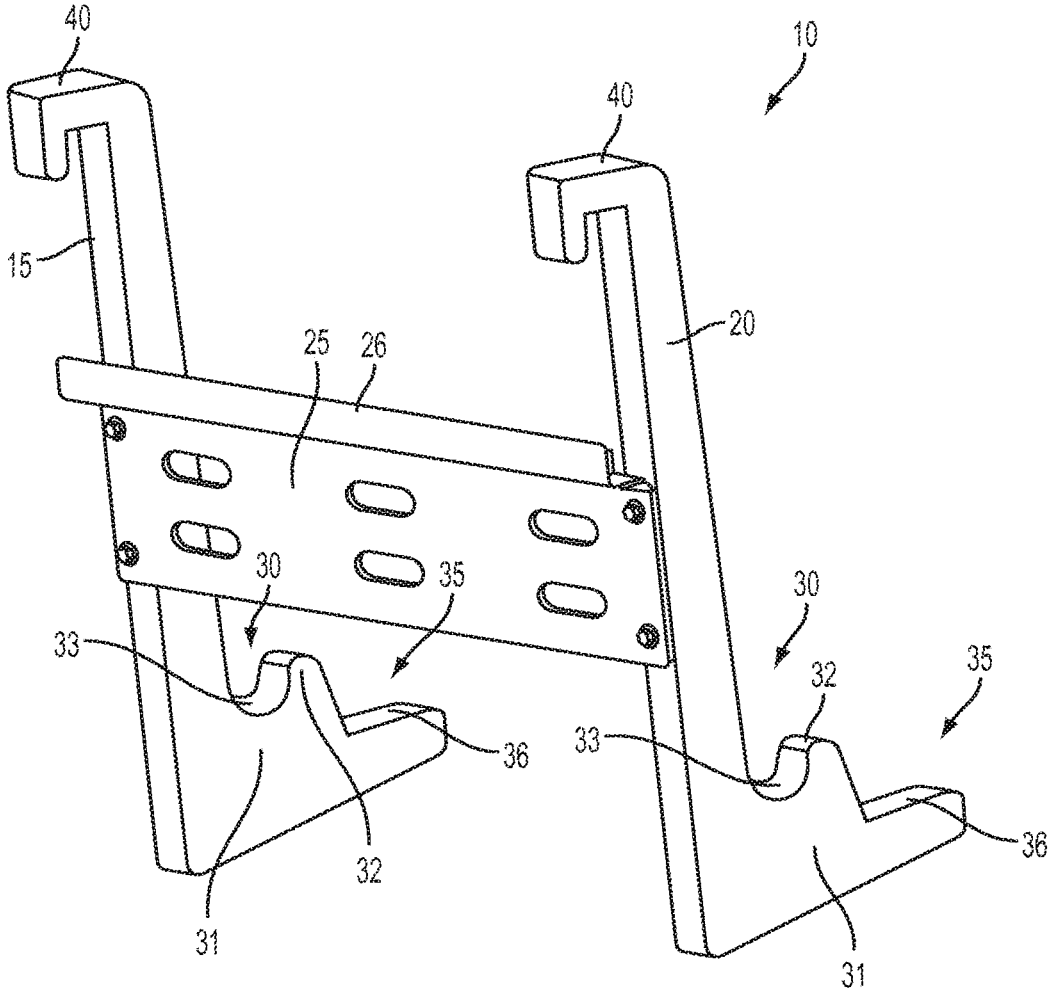
FIG. 1 illustrates a rear right-hand side isometric view of a mast hanger embodiment.
Figure 2:
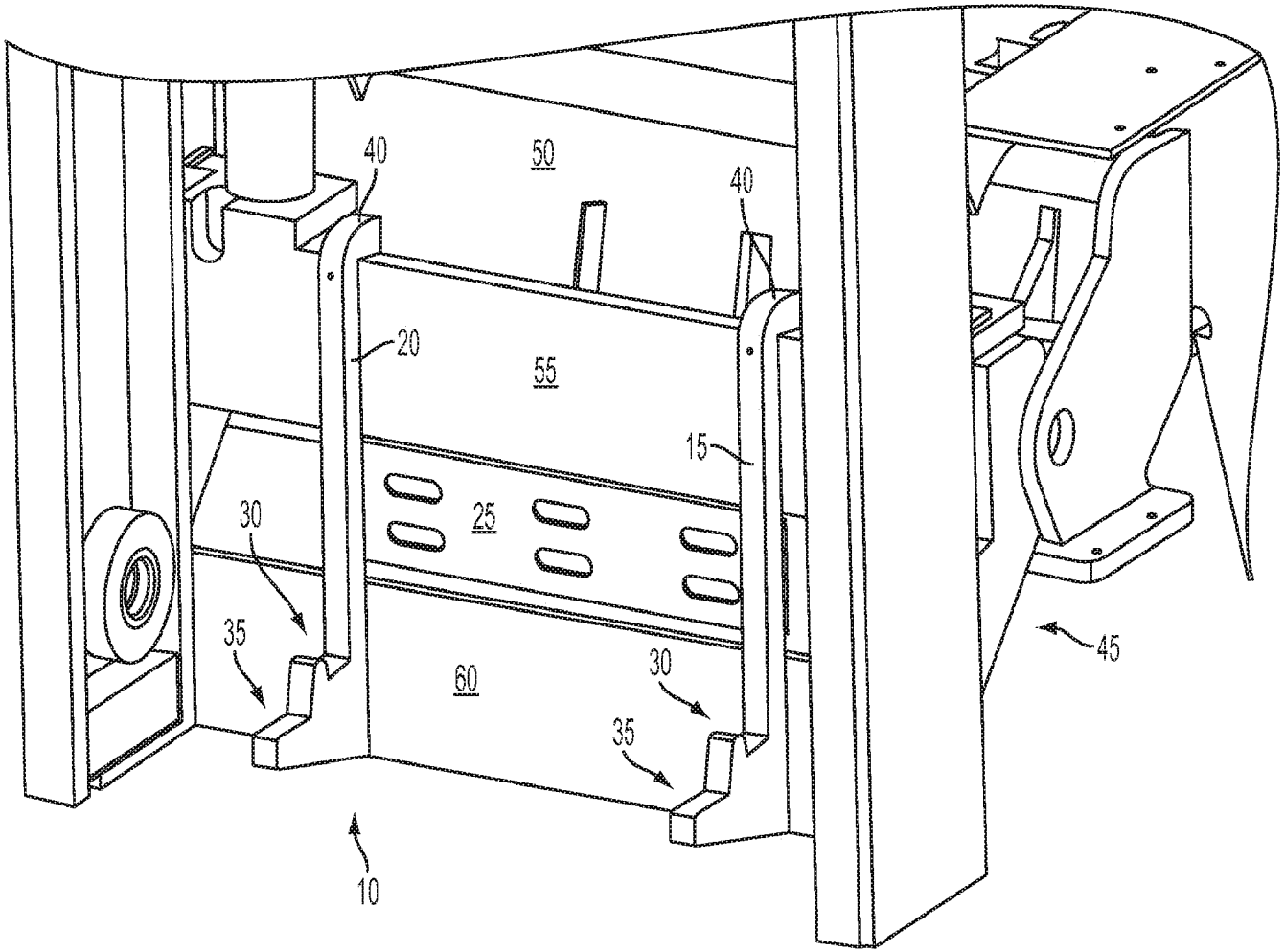
FIG. 2 illustrates a front left-hand side isometric view of the mast hanger of a lift truck mast.
Figure 3:
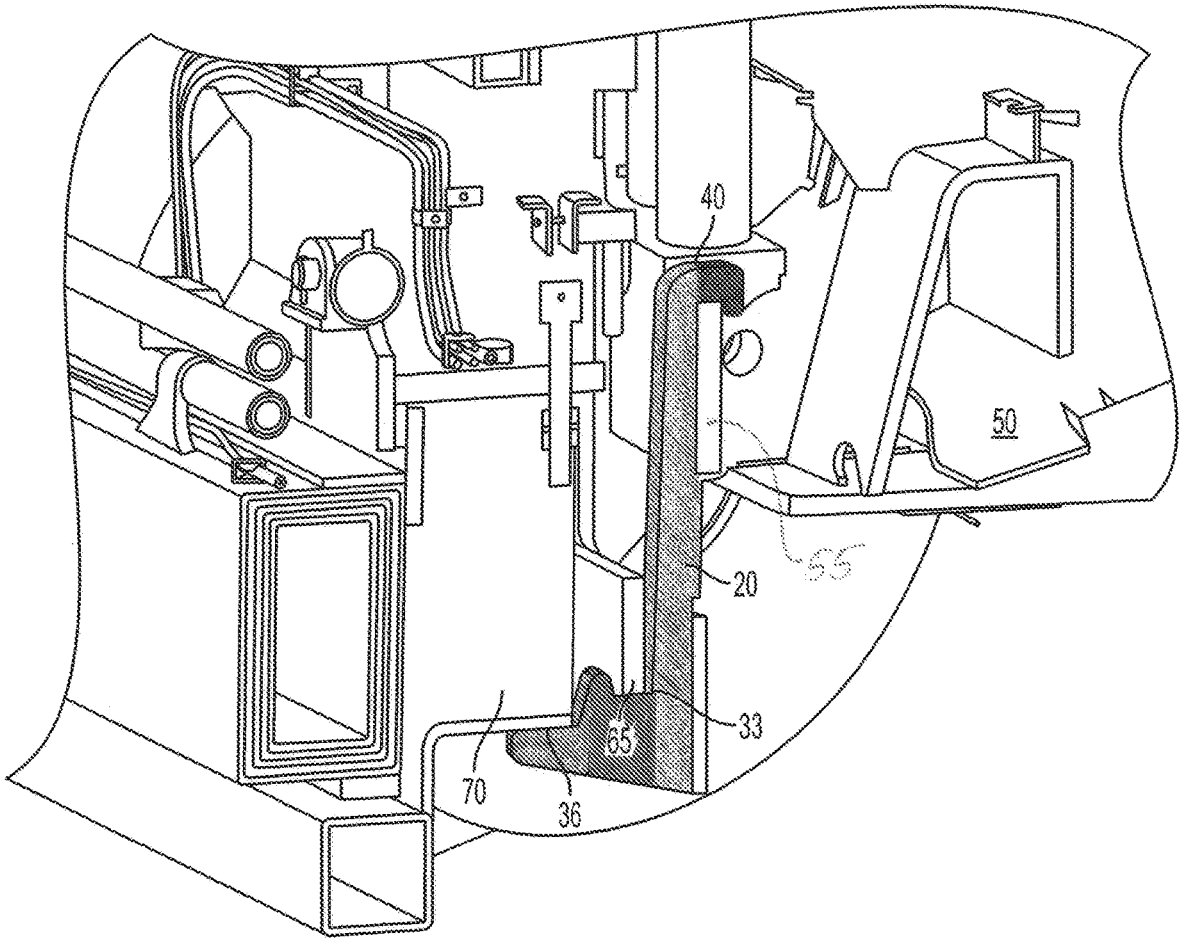
FIG. 3 illustrates a left-hand side cut away view of the mast hanger of FIG. 1 on a lift truck mast.

A device for facilitating lift chain tension relief is illustrated in FIGS. 1-3. A mast-hanger 10 includes a first support

15 and a second support 20 that are connected by an optional spacer 25. Each of the first support 15 and the second support 20 include a mast receiving formation 30, an attachment receiving formation 35, and an optional mast attachment 40. In the embodiment illustrated in FIG. 1, the mast receiving formation 30 comprises a raised portion 31 and a lip 32 that forms a pocket 33. The attachment receiving portion 35 comprises a sloped shelf 36. The mast attachment 40 comprises a hook-shape. Preferably, each of the first support 15 and the second support 20 are integrally formed with a mast receiving formation 30, an attachment receiving formation 35, and a mast attachment 40, for example, by casting, forging, cutting, or stamping using ductile iron, steel, or other suitable material. Optionally, the first support 15 and the second support 20 may be formed by providing an elongate bar and securing one or more of a mast receiving formation 30, an attachment receiving formation 35, and a mast attachment 40 to each elongate bar by welding, bolting or other suitable attachment.

Figure 1A:
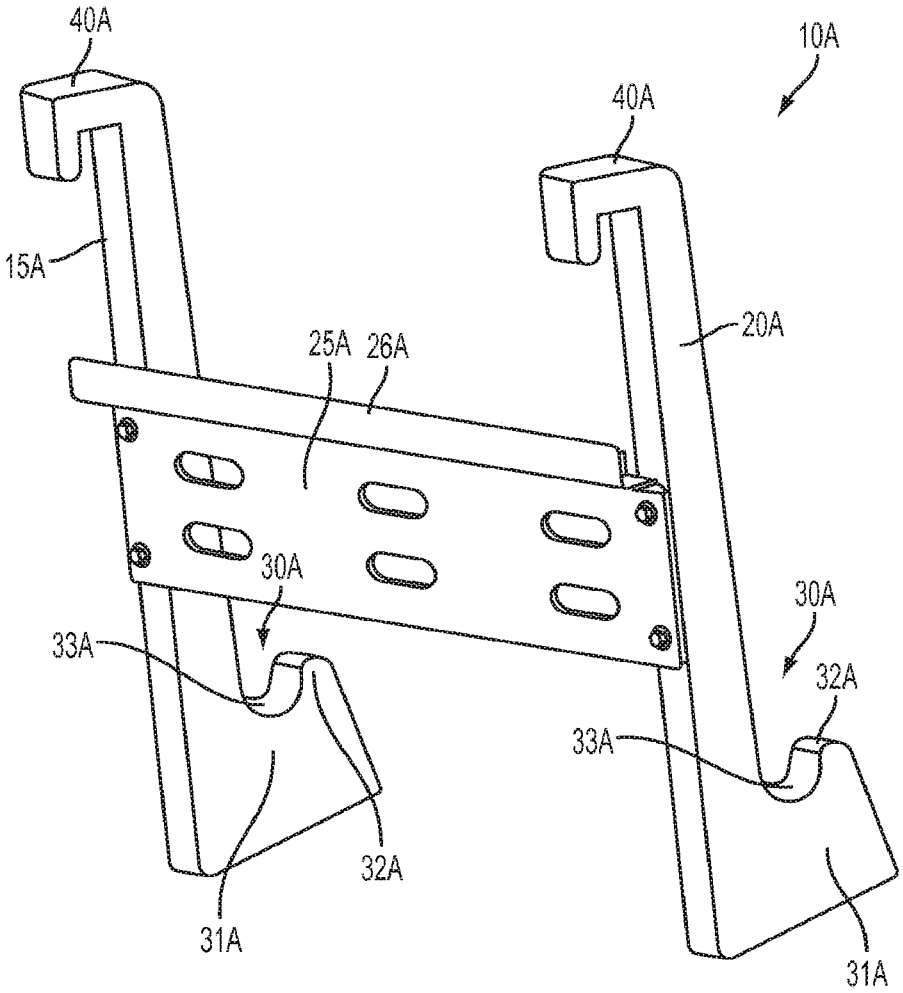
FIG. 1A illustrates a rear right-hand side isometric view of another mast hanger embodiment.
Figure 1B:
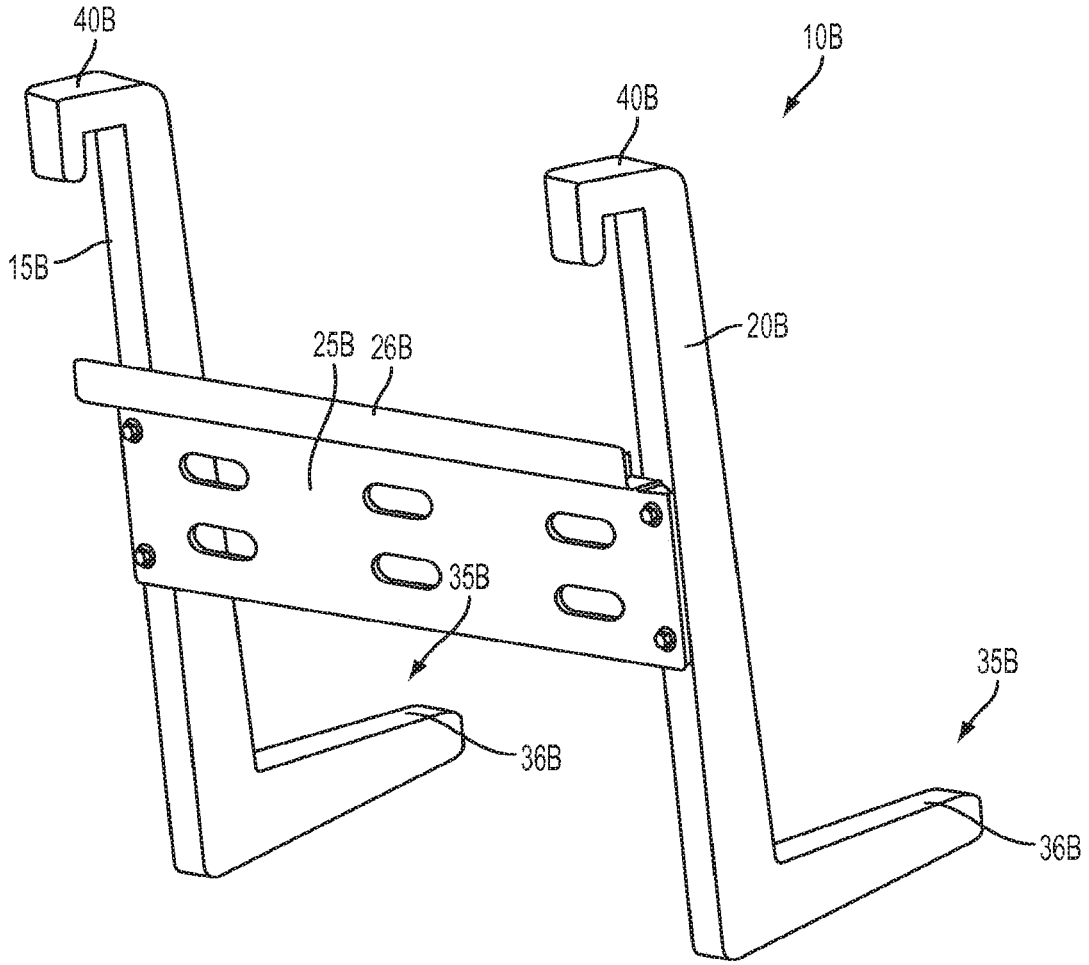
FIG. 1B illustrates a rear right-hand side isometric view of another mast hanger embodiment.

In other embodiments, a mast hanger 10A includes only a mast receiving formation 30A (FIG. 1A). In other embodiments, a mast hanger 10B includes only an attachment receiving formation 35*b* (FIG. 1B).

The optional spacer 25 is preferably secured to each of the first support 15 and the second support 20 via bolts, welds, or other suitable attachment. The spacer 25 may be constructed from a relatively lightweight material such as sheet metal or a rigid plastic.

FIG. 2 illustrates the mast-hanger 10 of FIG. 1 installed on a two stage mast 45 of a lift truck 50 (partially illustrated) where the second stage is removed for clarity. Optionally, the mast may include more than two stages and the mast hanger 10 may include one or more mast receiving formations, such as mast receiving formation 30. The mast-hanger 10 hangs on a cross member 55 of the two stage mast 45 via the mast attachments 40. Optionally, for a mast with more than two stages, multiple mast-hangers, such as mast hanger 10 or mast hanger 100, may be provided, preferably with one mast-hanger on a fixed stage and one or more mast hangers on one or more moveable stages. A lip 26 (FIG. 1) of the optional spacer 25 facilitates maintaining the first support 15 and the second support 20 in contact with cross members 55 and 60 by engaging a back-side of the cross member 55. Optionally, the mast-hanger 10 may be bolted, welded, or otherwise suitably secured in place. In some embodiments where the first support 15 and the second support 20 are secured in place, one or both of the optional spacer 25 and mast attachment 40 may be omitted. In other embodiments, the optional spacer 25 may be omitted even if the mast-hanger 10 is not bolted, welded or otherwise fastened to the two stage mast 45.

FIG. 3 illustrates the mast-hanger 10 of FIG. 1 supporting the second stage 65 of the two stage mast 45 and an attachment 70. By the nature of their design, construction, kinematics, dimensions, weight, or other relevant characteristic, some attachments do not permit a lift truck operator to fully lower the attachment to the ground, thus removing some or all of the tension in the lift chains. For example, attachments designed to handle empty cargo containers typically cannot be set on the ground and thus do not permit a lift truck operator to fully lower such attachments.

Pocket 33 is shaped and sized to receive the second stage 65 of the two stage mast and thus transfer some or all of the weight of the second stage 65 from the lift chains to the cross member 55. Sloped shelf 36 is shaped and sized to receive the attachment 70 and thus transfer some or all of the weight of the attachment 70 from the lift chains to the cross member 55. In the illustrated embodiment, the attachment 70 includes an integrated carriage. However, some carriages are not integrated with an attachment, and in certain embodiments the sloped shelf 36, or another suitable portion of a mast-hanger, is preferably shaped and sized to receive such a non-integrated carriage, a non-integrated attachment, or both. An attachment receiving portion is therefore a portion of a mast-hanger that is (1) sized and shaped to receive an integrated carriage and attachment, (2) sized and shaped to receive a non-integrated carriage, (3) sized and shaped to receive a non-integrated attachment, or (4) sized and shaped to receive a non-integrated carriage and a non-integrated attachment. Preferably, the two stage mast 45 is oriented in a substantially vertical position to facilitate transferring some or all of the weight of the second stage 65 and of the attachment 70 to the cross member 55. Optionally, the mast receiving formation 30, the attachment receiving formation 35, or both, may be shaped, sized and located such that the two stage mast 45 may be substantially vertical without some or all of the weight of one or both of the second stage 65 and the attachment 70 creating stress, and thus tension, on the lift chains.

When a mast-hanger, such as mast-hanger 10, is used with a lift truck equipped with an attachment that does not permit the operator to fully lower the attachment to the ground, such mast-hanger provides a location at which the mast, the carriage, the attachment, or any combination thereof, including all three, may be placed to remove all, substantially all, or a portion of the tension from the lift chains. When all, substantially all, or a portion of the tension is removed from the lift chains, such lift chains may have an extended life compared to lift chains of an equivalent lift truck equipped with the same attachment, but without a mast-hanger. For example, lift chain life may be extended because the relaxed tension may permit lubrication oil to flow into the links better than if such tension were not removed from the lift chains. As another example, lift chain life may be extended because relaxing or removing tensions from such lift chains reduces internal stresses within such lift chains.

Figure 4:
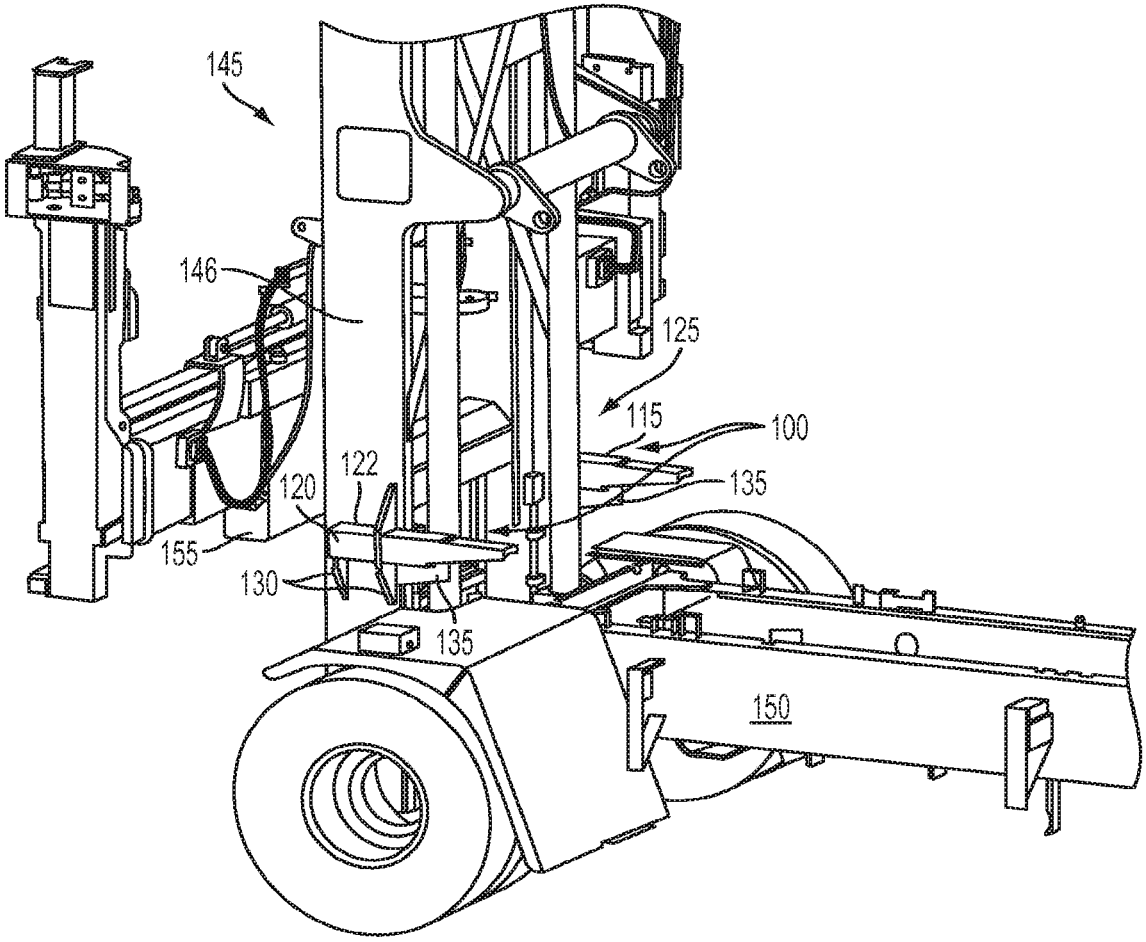
FIG. 4 illustrates a rear left-hand side isometric view of another mast hanger embodiment at a non-mast receiving position.
Figure 5:
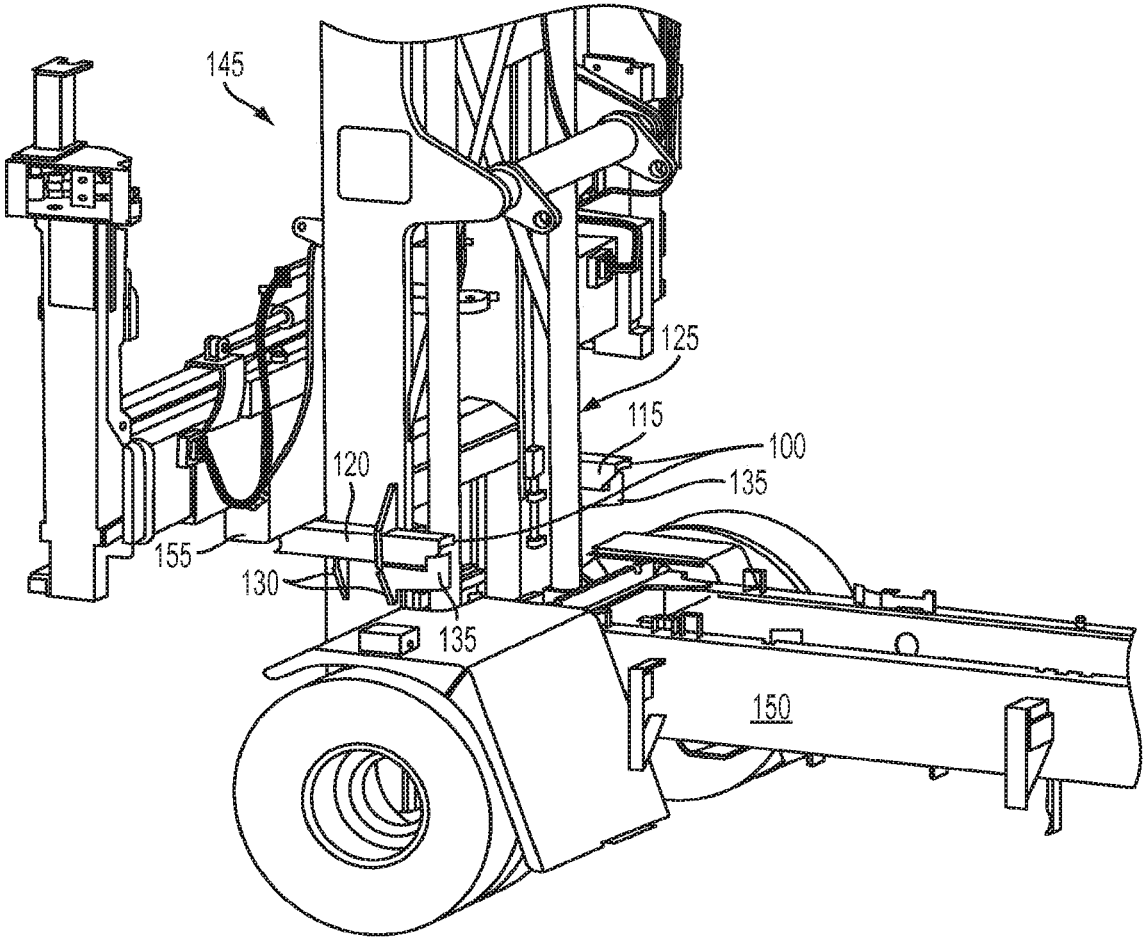
FIG. 5 illustrates a rear left-hand side isometric view of the mast hanger embodiment of FIG. 4 at a mast receiving position.

Another device for facilitating lift chain tension relief is illustrated in FIGS. 4 and 5. Details of the lift truck 150 and mast 145 are omitted for clarity. Likewise, no attachment is illustrated on the mast 145. The mast-hanger 100 includes two supports comprising a first beam 115 and a second beam 120 that are supported by a first stage 146 of a multi-stage mast 145. In the illustrated example, the multi-stage mast 145 is a two-stage mast, however more than two stages may be included, or the mast may not be a multi-stage mast and only one stage may be included. Beams 115 and 120 are supported by beam supports 125 and 130, respectively, such that beams 115 and 120 are moveable with respect to the first stage of the multi-stage mast 145. In the illustrated example, beams 115 and 120 slide with respect to beam supports 125 and 130, however beams 115 and 120 may rotate or pivot with respect to beam supports 125 and 130, or may otherwise be suitably configured for movement with respect to the first stage 146 of the multi-stage mast 145.

Beams 115 and 120 may be manually moveable, or may be moveable via an automated device, such as hydraulic extension cylinders 135, an electric linear actuator, an electric motor, or other suitable motive source. Two supports are illustrated, but some embodiments include only one support and other embodiments include three or four supports.

Figure 8:
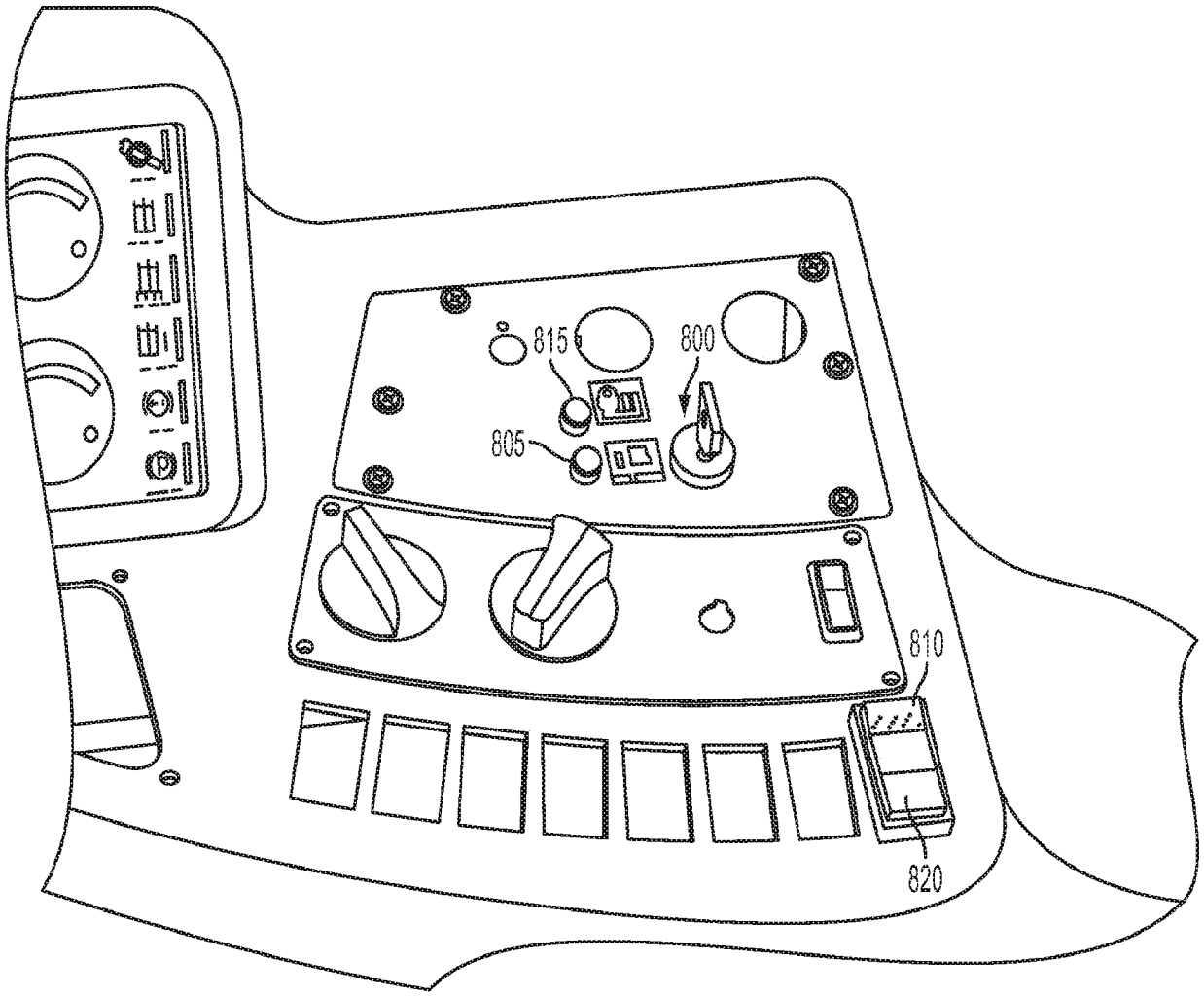
FIG. 8 illustrates an exemplary schematic of a mast hanger system interface.

Mast hanger 100 optionally includes one or more signal devices, such as lights 805 and 815 (FIG. 8). A signal device may be mounted on a portion of a Lift truck such as an operator compartment, or other suitable location where the signal device may be readily viewed by the lift truck operator. In other embodiments, the signal device may include a hand-held electronic device that wirelessly communicates with a mast hanger and provides operational information regarding the mast hanger via a screen, such as by displaying printed information or graphic information.

The signal device communicates with the mast hanger, such as mast hanger 100, and is configured to provide information regarding the operational status of the mast hanger to someone viewing the signal device. In the embodiment illustrated in FIGS. 4 and 5, the mast hanger 100 is associated with one or more position sensors, such as optical sensors, an encoder associated with the motive source, one or more Hall-effect sensors and one or more magnets, or other suitable position sensor for providing a signal indicative of the position of the beams 115 and 120. One signal indicates that the beams 115 and 120 are in a fully retracted, or non-mast receiving, position (illustrated in FIG. 4) where the beams 115 and 120 do not interfere with lowering the second stage 133 of the mast 145. Another signal indicates that the beams 115 and 120 are in a fully extended, or mast receiving, position (illustrated in FIG. 5) where the beams 115 and 120 inhibit lowering the second stage 155 of the mast 145.

Additional sensors that detect the position of the mast 145, an attachment connected to the mast, or both, optionally communicate with the signal device. By knowing the position of the mast 145, an attachment, or both, the signal device may indicate to the operator when a roast hanger receives the mast 145, an attachment, or both and provide a signal to inform the operator that the mast 145 should not be lowered any further. Optionally, an indication that a roast hanger receives the mast 145, an attachment, or both may be communicated to a processor on-board a lift truck and the processor may inhibit or prevent the operator from further lowering the mast 145, an attachment, or both. Inhibiting or preventing further lowering of the mast 145, an attachment, or both once received by a mast hanger may prevent the lift chains from becoming excessively slack which may cause the hit chains to become damaged or move out of alignment, or may cause unwanted stress from a sudden impact on the chains when the mast 145, an attachment, or both are lifted from the mast hanger.

Optionally, a strain gauge or other suitable weight bearing determination device may be associated with the beams 115 and 120 to provide an additional signal that the beams 115 and 120 are bearing at least a portion of the weight of the second stage 155 of the mast 145 and of any attachment and load connected to the mast 145. When an optional weight bearing determination device is included, an illuminated light or other suitable indicator that indicates that the beams 115 and 120 are at the fully extended position may only be illuminated if the beams 115 and 120 are at the fully extended position and are bearing weight, or there may be one indicator, such as an illuminated light, that indicates that the beams 115 and 120 are at the fully extended position and another indicator, such as an illuminated light, that indicates that the beams 115 and 120 are bearing weight.

Optionally, a shock absorber, such as an impact pad, damper or other suitable device for absorbing some of the shock resulting from contacting the mast 145, an attachment, or both with the beams 115 and 120 may be included. For example, a shock absorber 122 (FIG. 4) may be provided on a top surface of beams 115 and 120. Shock absorber 122 may be a pad of resilient material, such as natural rubber, soft plastic, or other suitable material, that is affixed to the beams 115 and 120; or shock absorber 122 may include dampening devices such as springs, resilient absorbers or other suitable devices interposed between a contact plate and the beam 115 or 120. Likewise, a shock absorber 122, or other suitable device, may be located on the top side of pocket 33, sloped shelf 36, or both (FIG. 1).

Figure 6:
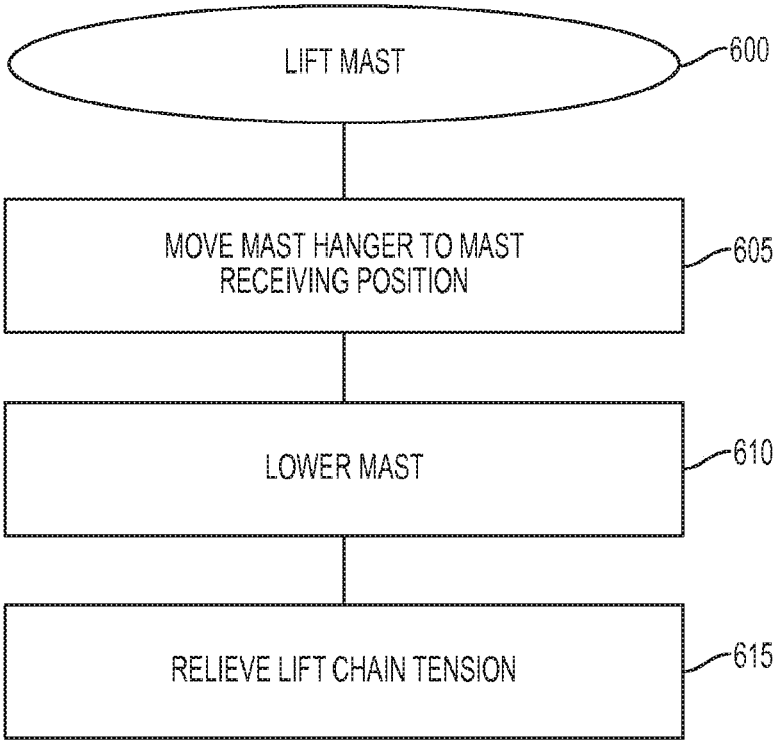
FIG. 6 illustrates a flow chart of an exemplary method of relieving tension from lift chains.

FIG. 6 illustrates a flowchart for a method of facilitating lift chain tension relief. At step 600, a lift truck operator raises a second stage of a multi-stage mast and an attachment above the position of a mast-hanger to an initial position. For example, an initial position may be any position above pockets 33 (FIG. 1) or the beams 115 and 120 (FIG. 4), but is preferably a position that is 5 cm to 25 cm above the pockets 33 or the beams 115 and 120. Optional step 605 involves moving the mast-hanger into a mast receiving position. Step 605 is optional for mast-hangers that may be maintained in a mast receiving position such as mast-hanger 10, for example. At step 610, the lift truck operator lowers at least the second stage of a multi-stage mast and optionally an attachment onto the mast hanger. At step 615, the lift truck operator continues to apply a lower command to the mast to relieve at least some of the tension from the lift chains as the weight of the attachment and at least the second stage of the multi-stage mast are transferred to the first stage of the multi-stage mast via the roast-hanger. In other words, the attachment does not contact the ground at step 615.

With reference to FIGS. 7 and 8, an exemplary process for operating a mast hanger that includes beams 115 and 120 is described. With the engine of a lift truck running, an operator activates the park brake at step 700. The operator then manipulates key switch 800 to the "on" position to activate the mast hanger system at step 705. A processor associated with the mast hanger system detects the activation of the park brake, and switches blue light 805 on at step 710 to indicate that the mast hanger system is active. If the processor does not detect that the park brake has been activated, the mast hanger system may prompt the operator to activate the park brake, for example, by flashing blue light 805. Preferably, any time there is an error with operation of the roast hanger system detected by the processor, the blue light 805 is flashed. The processor activates a park brake lock at step 715 to prevent disengagement of the park brake while the roast hanger system is active.

At step 720 the operator moves an attachment connected to the mast 145 into an initial position, for example, the operator may move a spreader for moving cargo containers to a position that is in the range of 5 cm to 25 cm above the beams 115 and 120, and preferably approximately 12 cm, and at step 725 the processor detects when the attachment is in an initial position by receiving input from a proximity switch or other suitable sensor positioned and configured to send a signal when the attachment is in the initial position. Optionally, the processor may cause the attachment to move into an initial position and may receive information from a proximity switch or other suitable sensor associated with the mast 145 to indicate when the attachment is in the initial position in response to receiving a signal, for example from a move to position switch (not illustrated) manipulated by the operator, from the extend switch 810, or from another suitable signal source.

At step 730 the processor activates a lowering interrupt function that inhibits or prevents the operator from lowering the attachment, and enables the extend switch 810. At step 735 the operator activates the extend switch 810 and the processor activates an automated device to extend the beams 115 and 120 to their extended positions. Optionally, the processor may automatically activate a lowering interrupt function and cause the beams 115 and 120 to extend in response to receiving a signal that the attachment is in an initial position above the beams 115 and 120, in response to receiving a signal from the extend switch 810, or in response to another suitable signal.

At step 740, the processor determines whether the beans 115 and 120 are at the retracted position, for example, via signals sent from a proximity switch, Hall effect sensor, or other suitable sensor, and if not, activates a reduced lowering speed function that limits the speed at which an attachment may be lowered. At step 745, the processor determines whether the beams 115 and 120 are at their extended positions, for example, via signals sent from a proximity switch, Hall effect sensor, or other suitable sensor, and if so, disables the extend switch 810 and deactivates the lowering interrupt function. At step 750, the operator lowers the attachment until the attachment, the mast 145, or both, contact the beams 115 and 120. Optionally, the processor may automatically activate a reduced lowering speed, deactivate the lowering interrupt function, and lower the attachment until the attachment, the mast 145, or both, contact the beams 115 and 120 in response to determining that the beams 115 and 120 are at their extended positions, or in response to another suitable signal.

Contact of the attachment, the mast 145, or both, with the beams 115 and 120 is detected at step for example, via signals sent from a proximity switch, strain gauge, or other suitable sensor, and the processor activates the lowering interrupt function and an indicator, such as green light 815, to indicate to the operator that the attachment, the mast 145, or both are in position on the beams 115 and 120. The processor also deactivates the retract switch 820.

To disengage the mast hanger system, the operator lifts the attachment, the mast 145, or both from the beams 113 and 120 at step 760. At step 765, the processor detects that the attachment, the mast 145, or both are no longer supported by the beams 115 and 120, for example, via signals sent from a proximity switch, strain gauge, or other suitable sensor, and enables the retract switch 820. The processor also disables the lowering interrupt function and turns the green light 815 off, thus indicating to the operator that the attachment, the mast 145, or both are no longer supported by the beams 115 and 120. The operator manipulates the retract switch 820 at step 770 and the beams 115 and 120 are moved to their retracted positions. Optionally, the processor may lift the attachment, the mast 145, or both from the beams 115 and 120, detect that the attachment, the mast 145, or both are no longer supported by the beams 115 and 120, disable the lowering interrupt function, turn the green light 815 off, and move the beams 115 and 120 to their retracted positions in response to receiving a signal from the retract switch 820, or from another suitable signal source.

At step 775, the processor detects whether the beams 115 and 120 are at their extended positions, for example, via signals sent from a proximity switch, hail effect sensor, or other suitable sensor, and if not, enables the extend switch 810 and the lowering interrupt function. At step 780, the processor detects whether the beams 115 and 120 are at their retracted positions, for example, via signals sent from a proximity switch, hall effect sensor, or other suitable sensor, and if so, deactivates the reduced lowering speed function, deactivates the lowering interrupt function, enables the extend switch 810, preferably only if the attachment, the mast 145, or both are in an initial position above the beams 115 and 120, and disables the retract switch 820.

The operator deactivates the mast hanger system at step 785 by manipulating the key switch 800 to the off position. At step 790, the processor deactivates the blue light 805 to indicate to the operator that the mast hanger system is deactivated and deactivates the park brake lock.

While the above has been described as a series of steps, the aggregation and order of the described operations is not important, and various operations may be combined or omitted.

The invention claimed is:

1. A mast-hanger comprising:

a first support and second support, each configured to be mounted to a first stage of a lift mast;

a first part of a mast attachment portion connected to the first support; and a second part of the mast attachment portion connected to the second support;

wherein the first support includes a first part of a mast receiving portion, and the second support includes a second part of the mast receiving portion;

wherein the mast receiving portion is sized, shaped, and positioned to (i) receive a second stage of the lift mast as the second stage is lowered and (ii) facilitate releasing tension from lift chains of the lift mast by transferring at least some of the weight of the second stage of the lift mast to the first stage of the lift mast via the first and second supports when the mast-hanger is mounted to the first stage of the lift mast and the second stage is received by the mast receiving portion;

wherein the first and second parts of the mast attachment portion connected to the first and second supports are shaped and sized to engage a cross member of the lift mast such that the mast-hanger hangs on the cross member when the mast-hanger is mounted to the first stage of the lift mast; and wherein the first and second supports are moveably mounted to the first stage of the lift mast.

2. A mast-hanger according to claim 1, further comprising a motive source operatively connected to the first and second supports to move the first and second supports between a retracted position and an extended position.

3. A mast-hanger according to claim 2, further comprising a signaling device operatively associated with the first and second supports to indicate a status of the first and second supports to an operator.

4. A mast-hanger according to claim 1, further comprising a shock absorber on each of the first and second supports.

5. A method for operating a lift truck equipped with the mast hanger of claim 1, comprising:

receiving a lift command and raising the second stage of the lift mast to an initial position in response to receiving the lift command;

receiving a lower command and lowering the second stage of the lift mast in response to receiving the lower command; and continuing to receive the lower command and operating a lowering mechanism of the lift mast to relieve at least some of the tension from the lift chains as the weight of the second stage of the lift mast is transferred to the first stage of the lift mast in response to continuing to receive the lower command.

6. A method for operating a lift truck according to claim 5, further comprising receiving an extension command and moving the mast-hanger into a mast receiving position in response to receiving the extension command.

7. A method for operating a lift truck according to claim 6, further comprising:

receiving a second lift command and raising the second stage of the lift mast in response to receiving the second lift command; and receiving a retract command and moving the mast-hanger into a non-mast receiving position in response to receiving the retract command.

* * * * *